US010765161B2

(12) United States Patent
Hokin

(10) Patent No.: US 10,765,161 B2
(45) Date of Patent: Sep. 8, 2020

(54) BANDANNA

(71) Applicant: Brad Jacob Hokin, Chicago, IL (US)

(72) Inventor: Brad Jacob Hokin, Chicago, IL (US)

( * ) Notice: Subject to any disclaimer, the term of this patent is extended or adjusted under 35 U.S.C. 154(b) by 405 days.

(21) Appl. No.: 14/866,002

(22) Filed: Sep. 25, 2015

(65) Prior Publication Data

US 2017/0086526 A1 Mar. 30, 2017

(51) Int. Cl.
*A42B 1/04* (2006.01)
*A42B 1/24* (2006.01)

(52) U.S. Cl.
CPC ..... *A42B 1/041* (2013.01); *A42B 1/248* (2013.01)

(58) Field of Classification Search
CPC ..... A42B 1/006; A42B 1/206; A42B 1/208; A42B 5/00; A42B 1/041; A42B 1/043; A42B 1/248; A42B 1/066; A41D 23/00; A41D 2023/008; A41B 15/00; A41B 15/02; A61F 13/15
USPC ..... 2/9, 206, 207
See application file for complete search history.

(56) References Cited

U.S. PATENT DOCUMENTS 290,621 A * 12/1883 Wood ..... A42B 1/006 2/209.12
1,749,340 A * 3/1930 Grean ..... A42B 1/041 2/195.7
2,199,427 A * 5/1940 Dohen ..... A42B 1/045 2/204
2,237,368 A * 4/1941 Seitzman ..... A41D 15/00 2/91
2,367,074 A * 1/1945 Turchin ..... A42B 1/208 2/204
2,417,323 A * 3/1947 Richards ..... A42B 1/12 2/68
2,585,686 A * 2/1952 Rossant ..... A41D 23/00 2/207
2,600,814 A * 6/1952 Tomarkin ..... A41D 23/00 2/207
2,824,311 A * 2/1958 Barnett ..... A41D 23/00 2/207

(Continued)

FOREIGN PATENT DOCUMENTS

DE 202013004608 U1 * 6/2013 ..... A41D 23/00
FR 2269274 A7 * 11/1975 ..... A41D 23/00

(Continued)

*Primary Examiner* — Sally Haden
(74) *Attorney, Agent, or Firm* — Gordon & Jacobson, P.C.

(57) ABSTRACT

A bandanna is provided that includes a generally square piece of material defining a first, second, third, and fourth corner. A first diametric axis bisects the first and second corners and a second diametric axis bisects the third and fourth corners. The material defines a first pair of diametrically opposed openings respectively at the first and second corner. The material is configured to be folded about the second diametric axis into a triangle to align the openings of the first pair of openings. The material is configured to interconnect at least one of the third and fourth corners with the first and second corners through the first pair of openings. The openings may be formed as elongated slits, which may extend along or parallel to the first diametric axis. The material may have at least one region for displaying indicia, including at least one of sports related graphics, non-sports related graphics, and corporate logos.

12 Claims, 12 Drawing Sheets

(56) References Cited

U.S. PATENT DOCUMENTS

| | | | | | |
|---|---|---|---|---|---|
| 2,883,670 | A * | 4/1959 | Pratt | A42B 1/045 | 2/207 |
| 4,993,080 | A | 2/1991 | Doty | | |
| 5,025,508 | A * | 6/1991 | Duncan | A41D 23/00 | 2/207 |
| 5,058,211 | A | 10/1991 | Hanks | | |
| 5,594,956 | A | 1/1997 | Barientos | | |
| 6,014,776 | A | 1/2000 | DeVinzio | | |
| 6,032,292 | A | 3/2000 | Wood et al. | | |
| 6,319,090 | B1 | 11/2001 | Gross | | |
| 6,353,937 | B1 * | 3/2002 | Martindale | A41D 23/00 | 132/200 |
| 6,401,255 | B1 * | 6/2002 | Douglas | A42B 1/225 | 2/207 |
| 6,763,785 | B1 * | 7/2004 | Grady | A01K 27/00 | 119/858 |
| 7,636,953 | B2 * | 12/2009 | Grey | A41D 23/00 | 2/174 |
| 2003/0011741 | A1 | 1/2003 | Gong | | |
| 2003/0070208 | A1 | 4/2003 | Magdziak-Hautala | | |
| 2004/0055071 | A1 | 3/2004 | Miska | | |
| 2005/0034215 | A1 * | 2/2005 | Harrison | A42B 1/008 | 2/207 |
| 2006/0090245 | A1 | 5/2006 | McGhee | | |
| 2007/0022518 | A1 * | 2/2007 | Sheu | A41D 23/00 | 2/207 |
| 2009/0199327 | A1 | 8/2009 | Hokin | | |
| 2016/0353816 | A1 * | 12/2016 | Strace | A41D 15/04 | |

FOREIGN PATENT DOCUMENTS

| | | | | |
|---|---|---|---|---|
| WO | WO 98/41120 | A1 | 9/1998 | |
| WO | WO-2005023032 | A1 * | 3/2005 | A41D 23/00 |

* cited by examiner

BANDANNA

BACKGROUND

1. Field

The present invention relates to a bandanna and in particular to a bandanna formed from a piece of material with an opening to facilitate tying the bandanna around a head of a wearer.

2. State of the Art

Bandannas are becoming increasingly popular headpieces. Examples of such bandannas are disclosed in U.S. Pat. Nos. 5,058,211; 6,032,292; 6,319,090 and U.S. Patent Application Publication US 2003/0011741 A1. Such bandannas normally consist of a generally square piece of fabric, for example, cotton, silk, rayon, or other fabric folded in half forming a triangle. The longest edge of the triangular piece of fabric is placed against the forehead of a wearer. The free end of the fabric is draped over the top of the head. When the two other ends of the fabric are tied over the free end of the fabric, a cap is formed on the head of the wearer, which loosely conforms to the shape of the wearer's head.

Headwear is also known which emulates a bandanna on the head of a wearer. Examples of such bandanna-like headwear are disclosed in U.S. Pat. No. 6,014,776; U.S. Patent Application Publication US 2003/0070208 A1 and International Patent Application Publication No. WO 98/41120. This bandanna-like headwear is generally preformed into a bandanna so that a wearer can have a bandanna look without the need to tie a piece of material into a bandanna. Unfortunately, such bandanna like headwear is much more expensive to manufacture than scarves used for conventional bandannas, thus driving up the cost of such bandanna-like headwear.

Bandannas are worn for various purposes, including protection of the wearer's head from the sun as well as for fashion reasons. Bandannas have not heretofore been known to be associated with sporting events. Instead, spectators of sporting events often wear other headwear, which sometimes includes the logo of the spectator's favorite sports team participating in the sporting event. For example, at baseball games, baseball spectators often wear baseball caps that display the logo of their favorite baseball team. Similarly, at football games, spectators often wear stocking caps that display the logo of their favorite football team.

SUMMARY

A bandanna is provided that includes a generally square piece of material defining a first, second, third, and fourth corner. A first diametric axis bisects the first and second corners and a second diametric axis bisects the third and fourth corners. The material defines a first pair of diametrically opposed openings respectively at the first and second corner. The material is configured to be folded about the second diametric axis into a triangle to align the openings of the first pair of openings. The material is configured to interconnect at least one of the third and fourth corners with the first and second corners through the first pair of openings. The openings may be formed as elongated slits, which may extend along or parallel to the first diametric axis. The material may be formed of at least one of fabric and paper. The material may have at least one region for displaying indicia, including at least one of sports related graphics, non-sports related graphics, and corporate logos.

A method of forming a bandanna is provided that includes providing a generally square piece of material defining a first, second, third, and fourth corner. A first diametric axis bisects the first and second corners and a second diametric axis bisects the third and fourth corners. The material defines a first pair of diametrically opposed openings respectively at the first and second corner. The method includes folding the material about the second diametric axis into a triangle to align the first pair of openings, passing the third corner and the fourth corner through both of the openings of the aligned first pair of openings, and connecting the third and fourth corner together.

DETAILED DESCRIPTION

Figure 1:
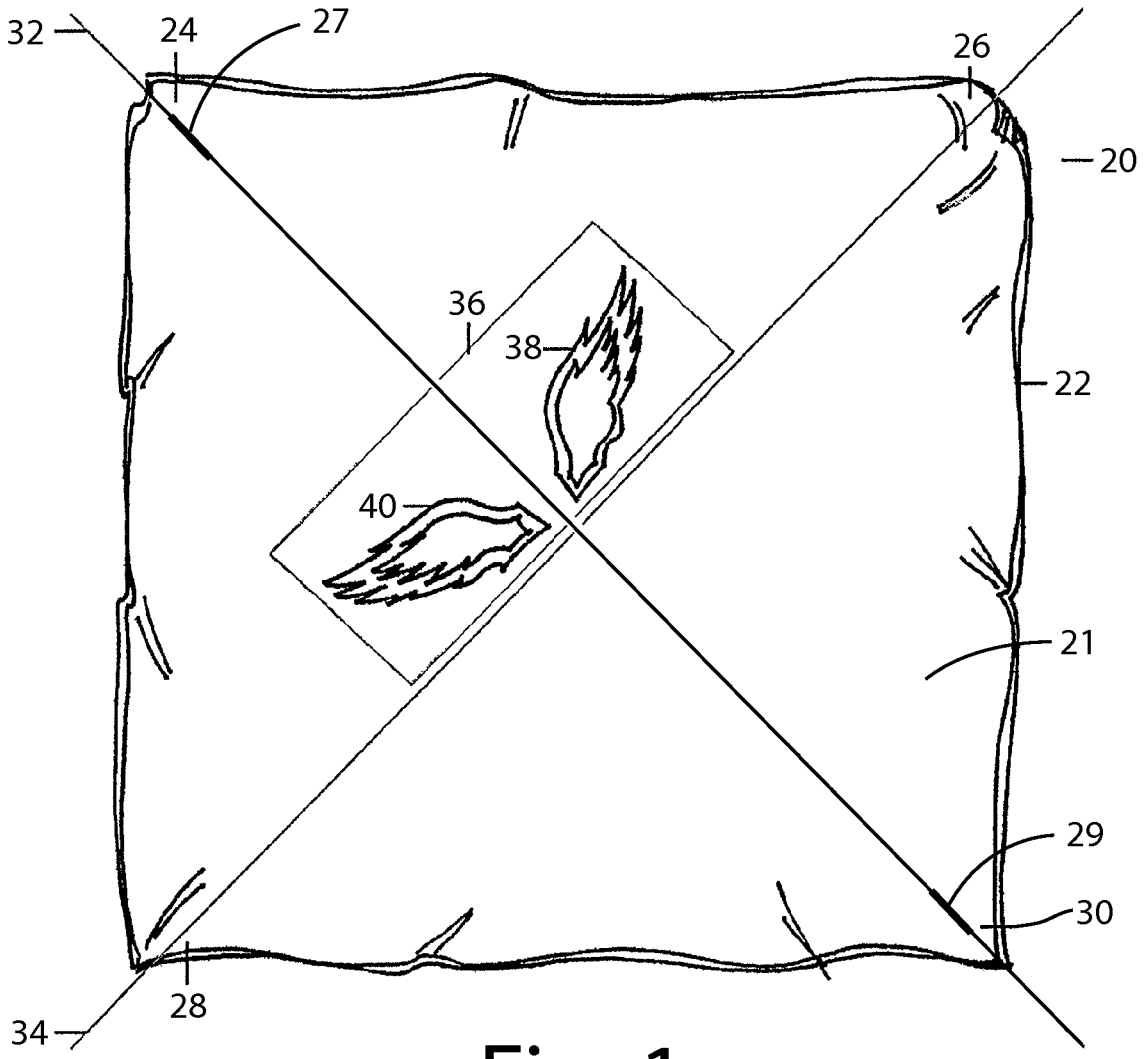
FIG. 1 is an illustration of an embodiment of an unfolded bandanna.

FIG. 1 illustrates an embodiment of a bandanna 20 in an untied condition. As shown, the bandanna 20 includes a generally square piece of material 21 defining four corners or ends, 24, 26, 28 and 30. The material 21 may be formed of at least one of fabric and paper. For illustration purposes, two diametric axes, 32 and 34, are superimposed on the material 21 in FIG. 1. It will be appreciated that the axes 32 and 34 are not actually displayed on the bandanna 20, but are illustrated merely for discussion purposes. In particular, a first diametric axis 32 generally bisects a first corner 24 and a second corner 30 while a second diametric axis 34 generally bisects a third corner 28 and a fourth corner 26. The material 21 defines a pair (set) of symmetrically positioned openings 27 and 29 that are symmetrical with respect to the second diametric axis 34; a first opening 27 at the first corner 24 and a second opening 29 at the second corner 30. In one embodiment, the first and second openings 27 and 29 are formed as elongated slits in the material 21. As illustrated in FIG. 1, the first and second openings 27 and 29 intersect the first diametric axis 32. More specifically, as illustrated in FIG. 1, the first and second openings 27 and 29 extend longitudinally along the first diametric axis 32. The slits may have a length of about one inch. It will be appreciated, however, that other opening shapes are possible and are within the scope of the invention. The openings 27 and 29 are sized to permit passage of at least one corner of the material 21. For example, one or more of the openings 27 and 29 may be formed as circular or oval shaped openings.

A display area 36 is located on the material 21. The display area 36 bounds an area in which indicia 38 and 40 may be displayed on the material 21. The indicia 38 and 40 may include text and/or graphics, such as sports teams and logos. In the illustrated embodiment, the display area 36 is located generally symmetrically relative to the first diametric axis 32 and disposed above the second diametric axes 34.

Figure 2:
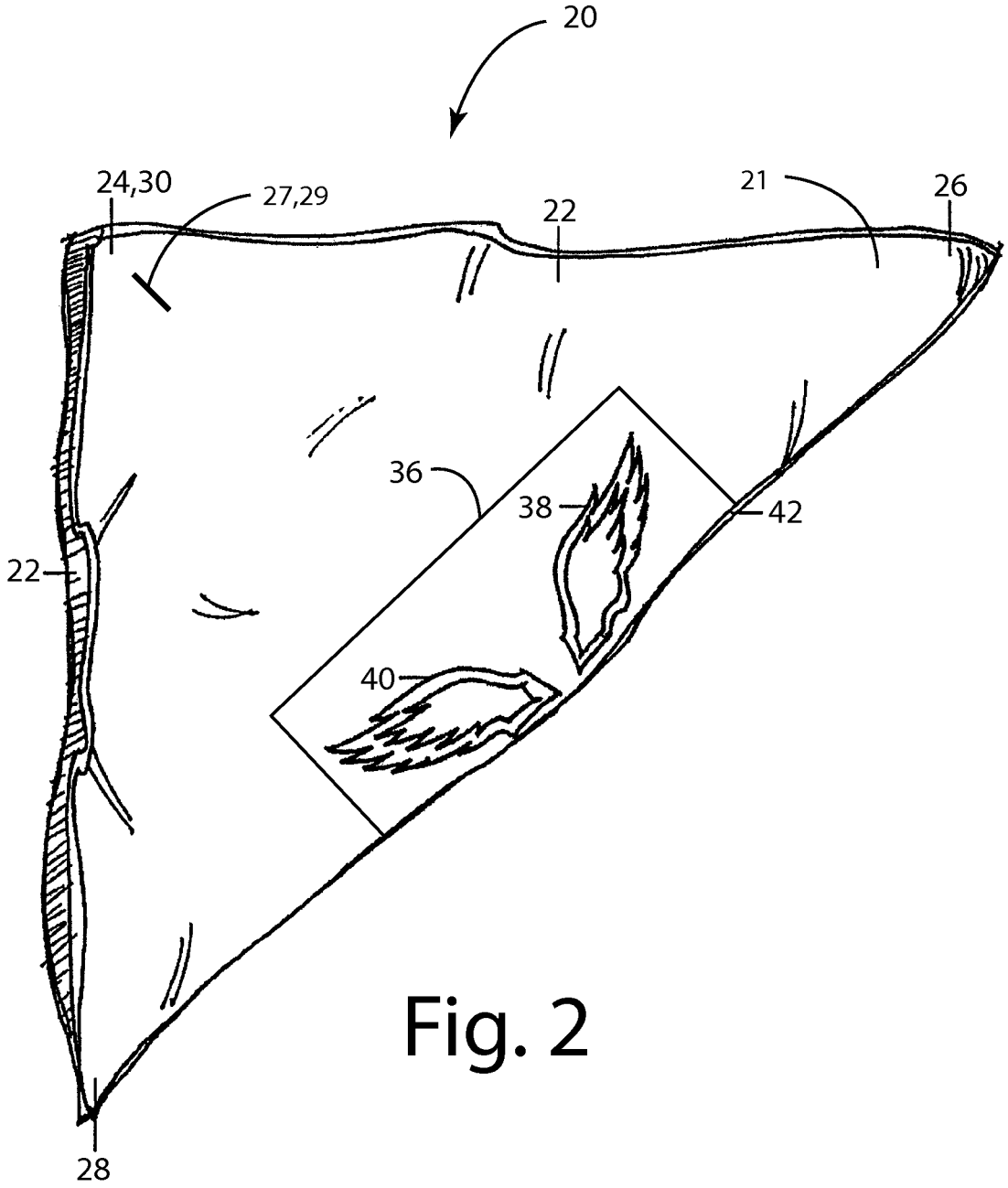
FIG. 2 shows the bandanna of FIG. 1 folded into a triangle along one diametric axis.

As shown in FIG. 2, folding the material 21 about the second diametric axis 34 into a triangle defines a long edge 42 that is generally parallel with the second diametric axis 34 (FIG. 1). Also, when folded into the triangle, the first and second openings 27 and 29 align with one another so that a through opening through both openings 27 and 29 may be used for passage of the third and fourth corners 28 and 26 of the bandanna 20, as described in further detail hereinbelow.

Figure 3:
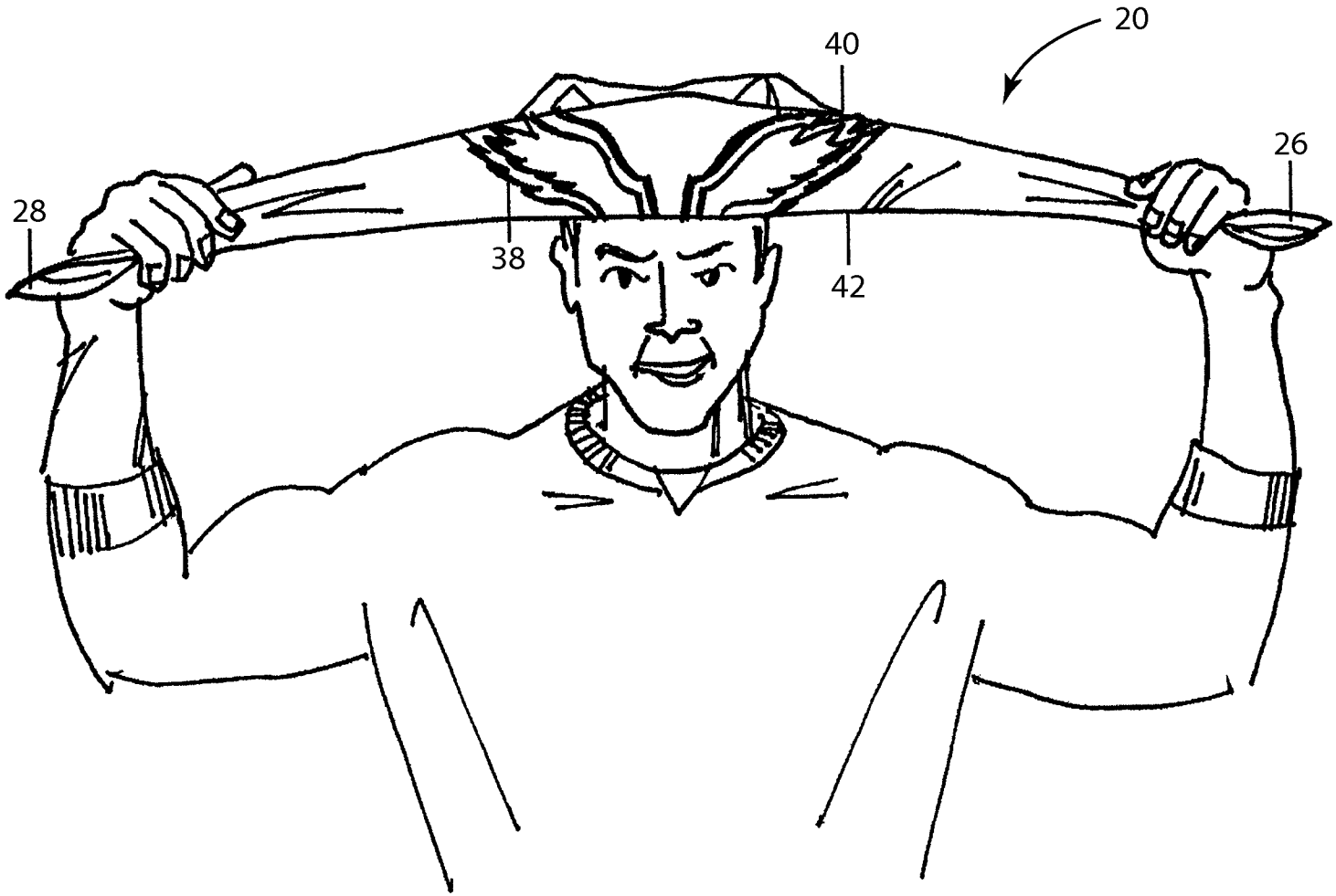
FIG. 3 illustrates a user placing the folded bandanna of FIG. 2 up to his or her forehead.
Figure 4:
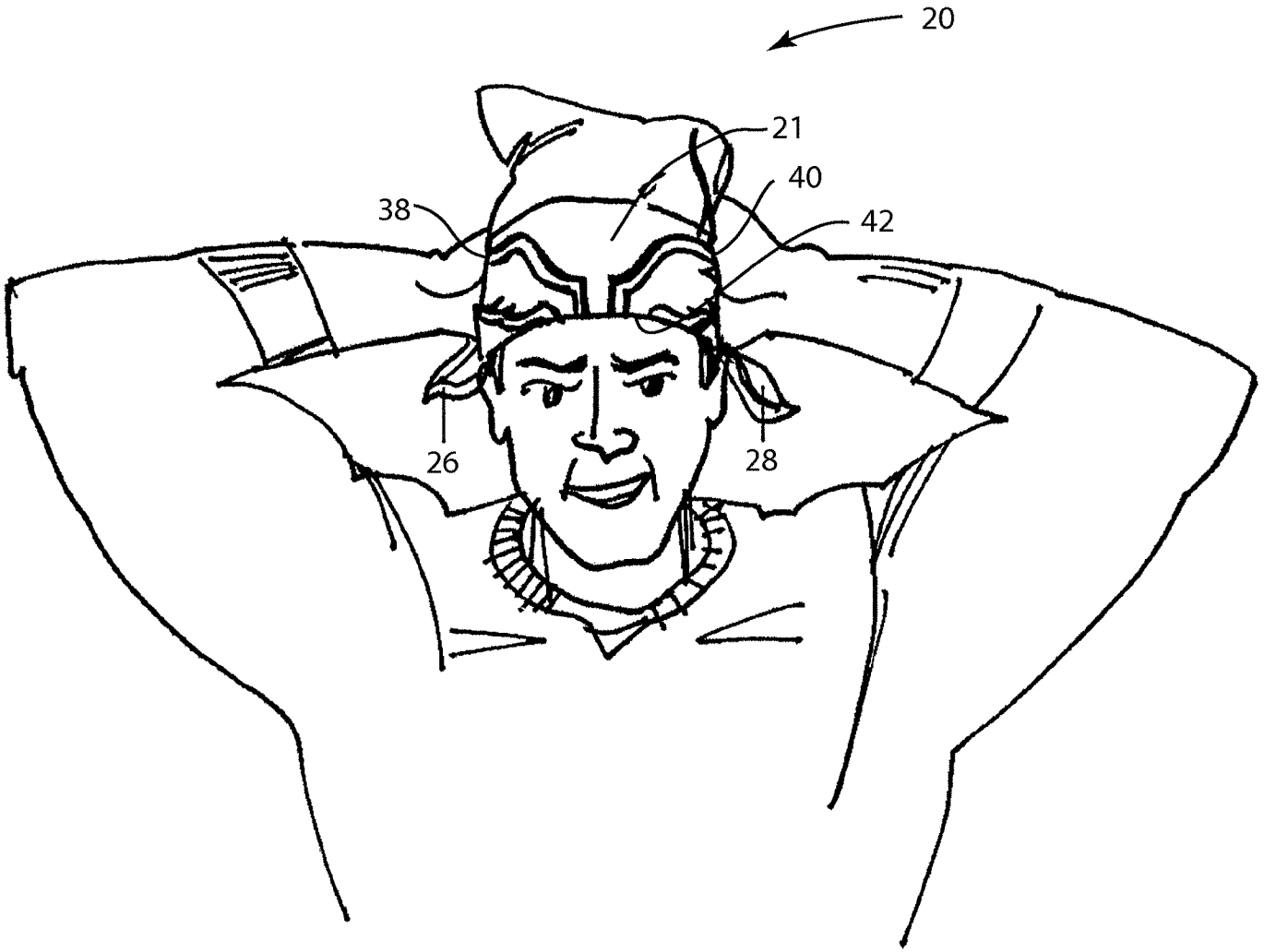
FIG. 4 illustrates a user handling the bandanna of FIG. 3 behind his or her head.
Figure 5A:
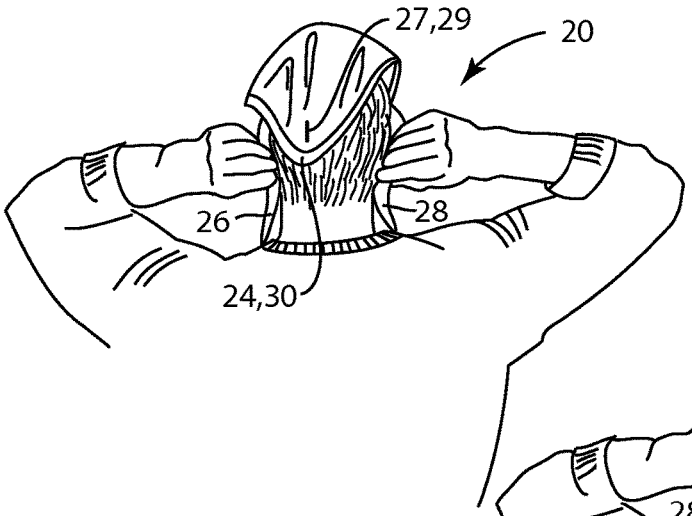
FIGS. 5A to 5D illustrate various steps of the user of FIG. 4 of tying the bandanna.

Turning to FIG. 3, after folding the material 21 into a triangle, a wearer grabs the folded corners 26 and 28 with their hands and positions the bandanna 20 such that the long edge 42 is against the wearer's forehead, as generally shown. In addition, the first and second corners 24 and 30 are draped over the top and back of the wearer's head as generally shown in FIG. 5A. By placing the long edge 42 of the bandanna 20 against the forehead of the wearer, indicia 38 and 40 that is located on the material 21 is oriented as generally shown in FIG. 4. The bandanna 20 shown in FIG. 4 shows the graphics 38 and 40 swept backwards along and close to the sides of the user's head and may be seen to emulate graphics displayed on a helmet, such as a football helmet.

Figure 5B:
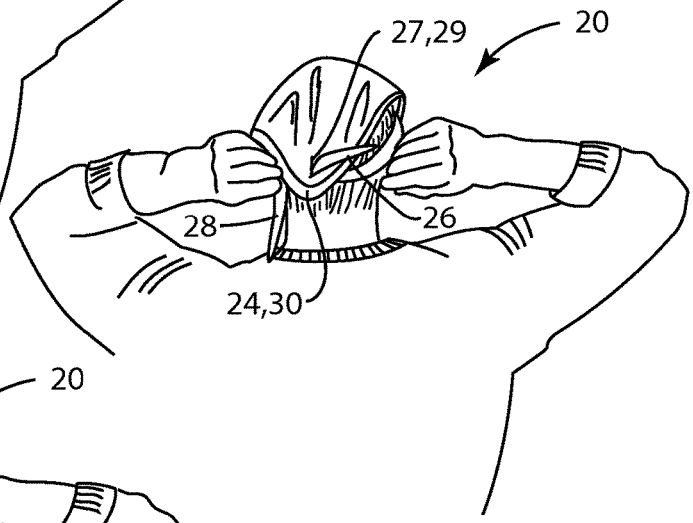
Figure 5C:
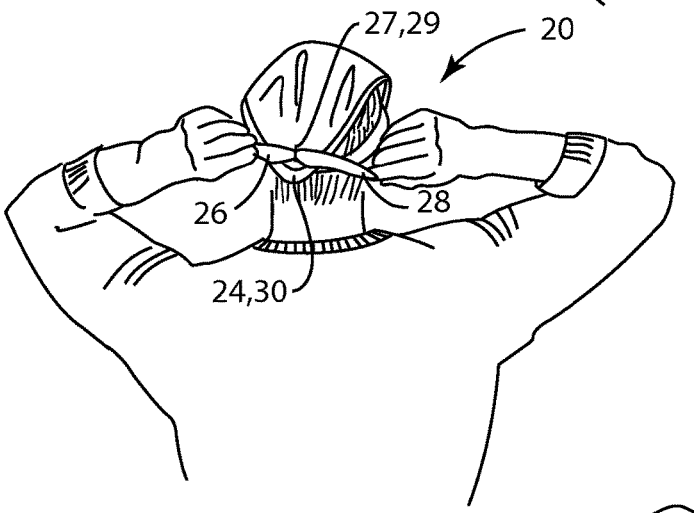
Figure 5D:
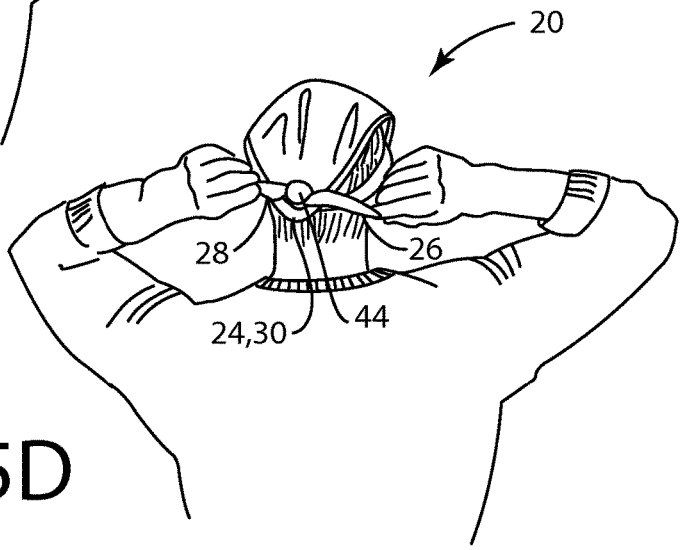

A method of tying the bandanna 20 will now be described with reference to FIGS. 5B to 5D. As shown in FIG. 5B, the fourth corner 26 is passed from a first direction through the aligned holes 27 and 29 and in FIG. 5C, the third corner 28 is passed from a second direction through the aligned holes 27 and 29. As shown in FIG. 5D, with the third and fourth corners 26 and 28 both being passed through the aligned holes 27 and 29, the third and fourth corners 26 and 28 are connected together, such as by being tied into a knot 44. As a result of passage of the third and fourth corners 26 and 28 through the aligned holes 27 and 29, the first and second corners 24, 30 are interconnected with the third and fourth corners 26 and 28, so that the tied bandanna can be worn as shown in FIG. 6.

Figure 6:
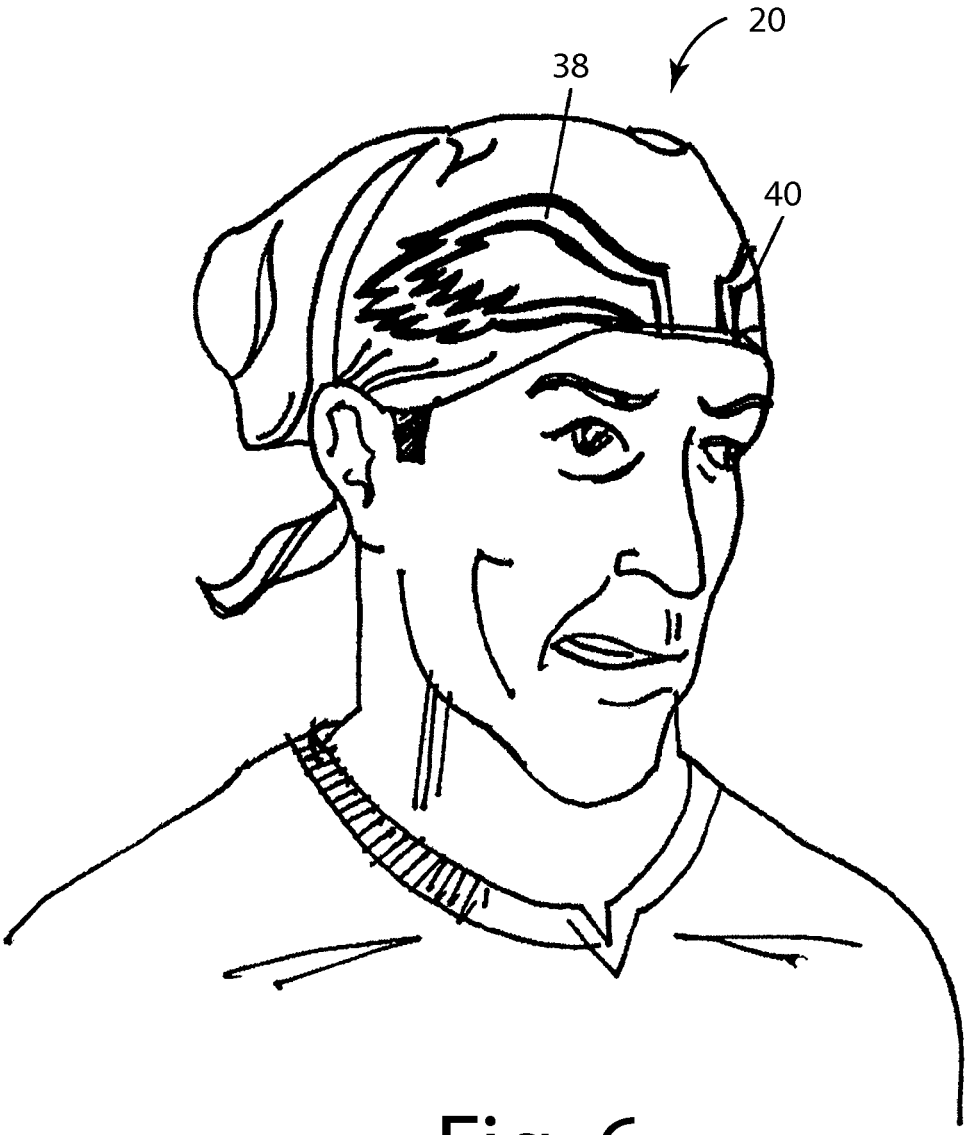
FIG. 6 is a perspective view illustrating the tied bandanna on the head of the wearer of FIGS. 3 to 5D with indicia on the bandanna displayed on the sides of the head of the wearer.

When the bandanna 20 is tied as shown in FIGS. 5A to 5D the third and fourth corners 26 and 28 are pulled taught so that the material 21 curves in conformity with the head of the wearer so that the bandanna 20 is form fitting, as shown in FIG. 6. Also, when the bandanna 20 is tied and the third and fourth corners 26 and 28 are pulled taught, the graphics 38 and 40 are displayed on opposing sides of a wearers head so as to emulate the graphics of a football helmet, as also shown in FIG. 6.

In comparison with conventional bandannas that are formed of a solid piece of material, the bandanna 20 described herein has an advantage of interconnecting the corners 24, 26, 28, and 30 of the material 21 such that there is less chance of the first and second corners 24 and 30 coming untucked from behind the wearers head. Thus, the wearer of the tied bandanna 20 shown in FIG. 6, for example, need not have to re-tie the bandanna in response to movement between the corners 24 and 30 and 26 and 28 of the material 21. Also, owing to the interconnection of the corners 24, 26, 28, and 30 of the material 21, when the tied bandanna 20 is tied and worn as shown in FIG. 6, the graphics 38 and 40 remain close to the wearer's head and the material 21 remains form fitting so that the tied bandanna 20 maintains the appearance of a football helmet.

Figure 7:
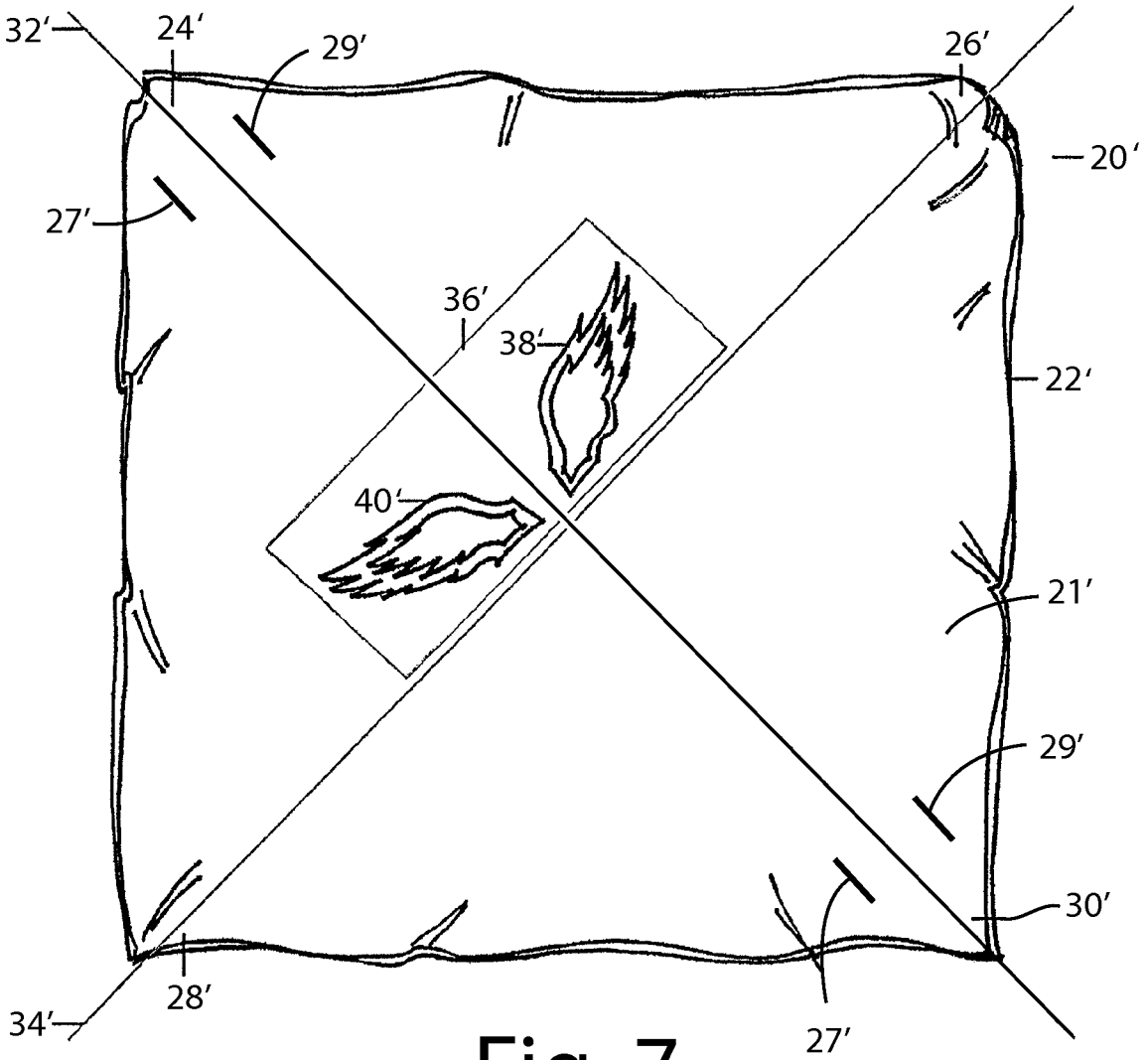
FIG. 7 is an illustration of another embodiment of an unfolded bandanna.

FIG. 7 illustrates another embodiment of a bandanna 20', which is shown in an untied condition. As shown, the bandanna 20' includes a generally square piece of material 21' defining four corners or ends, 24', 26', 28' and 30'. The material 21' may be formed of at least one of fabric and paper. For illustration purposes only, two diametric axes, 32' and 34', are superimposed on the material 21' in FIG. 7. In particular, a first diametric axis 32' generally bisects a first corner 24' and a second corner 30' while a second diametric axis 34' generally bisects a third corner 28' and a fourth corner 26'.

The material 21' defines a first pair (set) of diametrically opposed openings 27'; one opening 27' at the first corner 24' and a corresponding opening 27' at the second corner 30'. The first pair of openings 27' are located between the first diametric axis 32' and the third corner 28'. Also, the material 21' defines a second pair (set) of diametrically opposed openings 29'; one opening 29' at the first corner 24' and a corresponding opening 29' at the second corner 30'. The second pair of openings 29' are located between the first diametric axis 32' and the fourth corner 26'.

As illustrated in FIG. 7, the openings 27' and 29' are illustrated as elongated slits that extend longitudinally parallel with the diametric axis 32'. The slits may have a length of about one inch. It will be appreciated, however, that other opening shapes are possible and are within the scope of the invention. For example, one or more of the openings 27' and 29' may be formed as circular or oval shaped openings. The openings 27' and 29' are sized to permit passage of at least one corner of the material 21'.

A display area 36' is located on the material 21'. The display area 36' bounds an area in which indicia 38' and 40' may be displayed on the material 21'. The indicia 38' and 40' may include text and/or graphics, such as sports teams and logos. In the illustrated embodiment, the display area 36' is located generally symmetrically relative to the first diametric axis 32' and disposed above the second diametric axes 34'.

Figure 8:
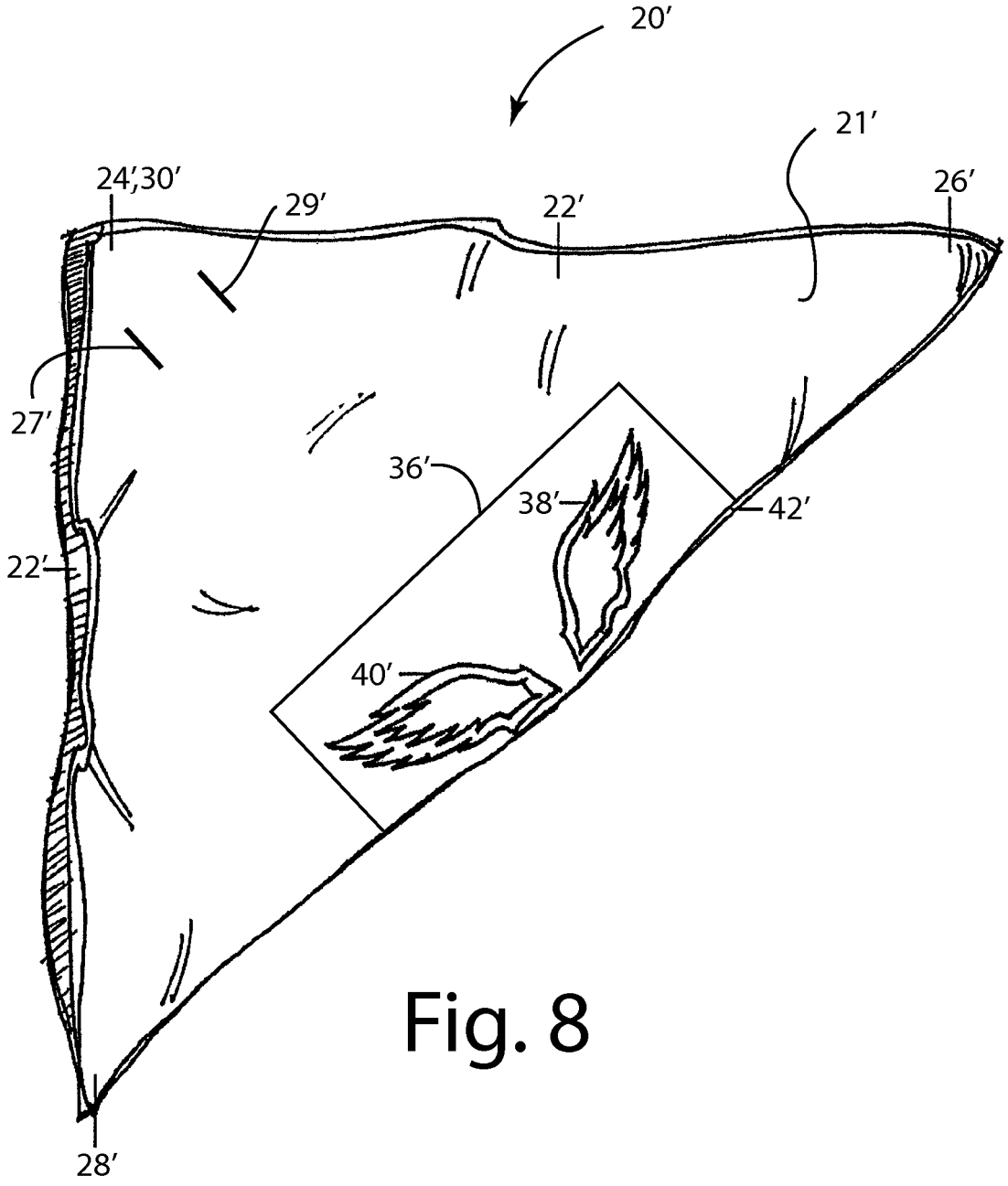
FIG. 8 shows the bandanna of FIG. 7 folded into a triangle along one diametric axis.

As shown, in FIG. 8, folding the material 21' about the second diametric axis 34' into a triangle defines a long edge 42' that is generally parallel with the second diametric axis 34' (FIG. 7). When folded into a triangle, the first set of openings 27' align with each other and the second set of openings 29' align with each other so that two through openings through each respective pair of openings may be used for passage of the third and fourth corners 28' and 26' of the bandanna 20', as described in further detail hereinbelow.

Figure 9:
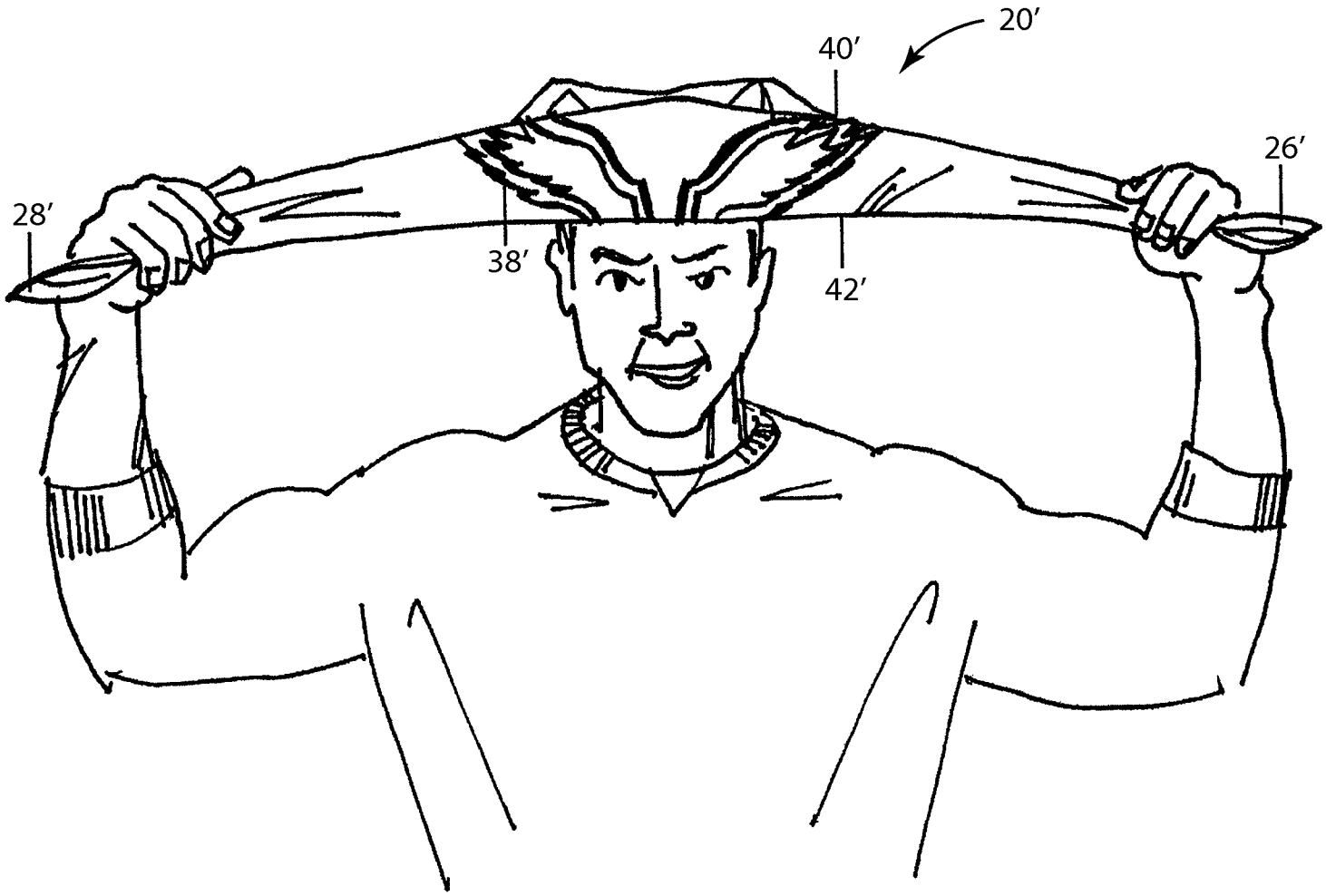
FIG. 9 illustrates a user placing the folded bandanna of FIG. 8 up to his or her forehead.
Figure 10:
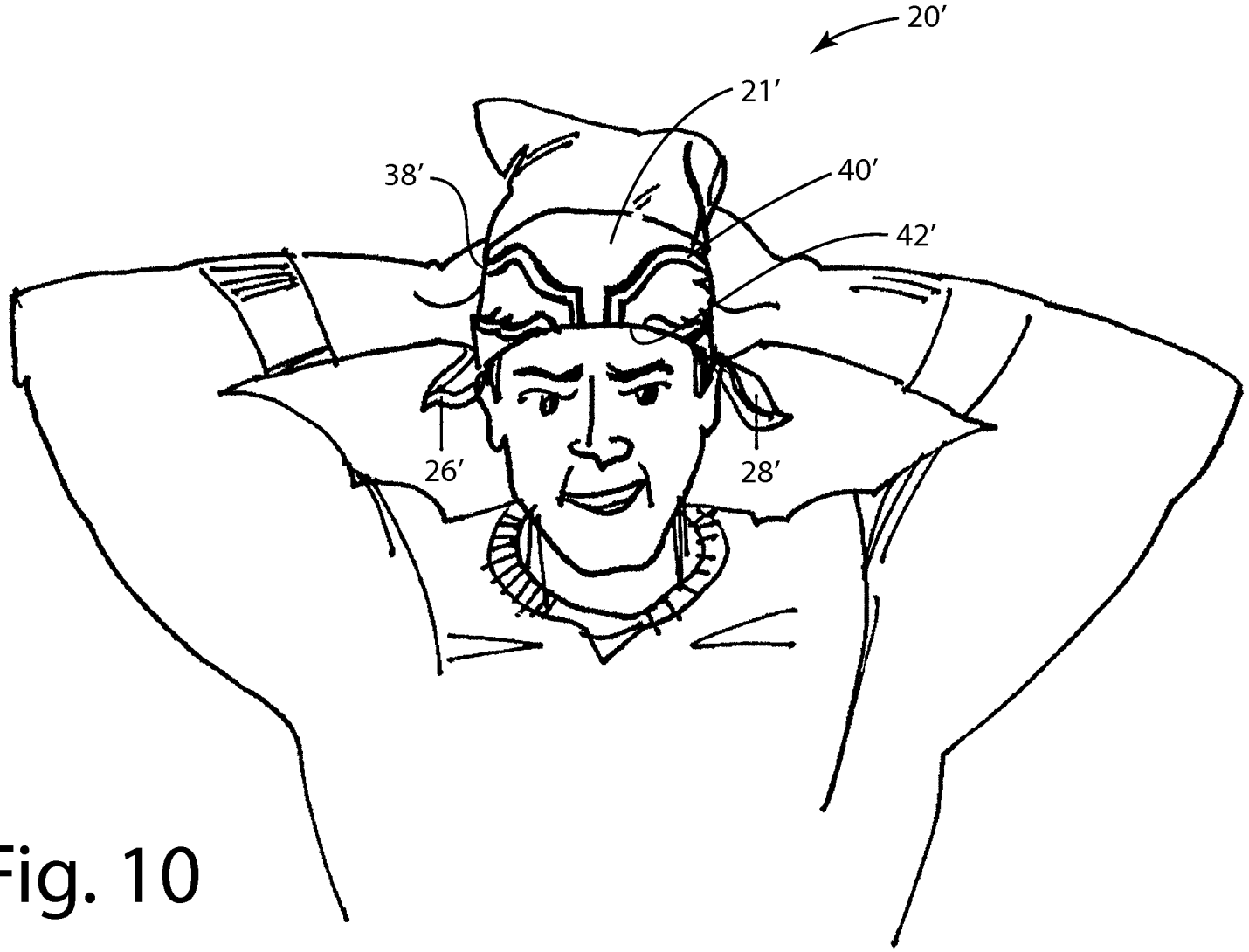
FIG. 10 illustrates a user handling the bandanna of FIG. 9 behind his or her head.
Figure 11A:
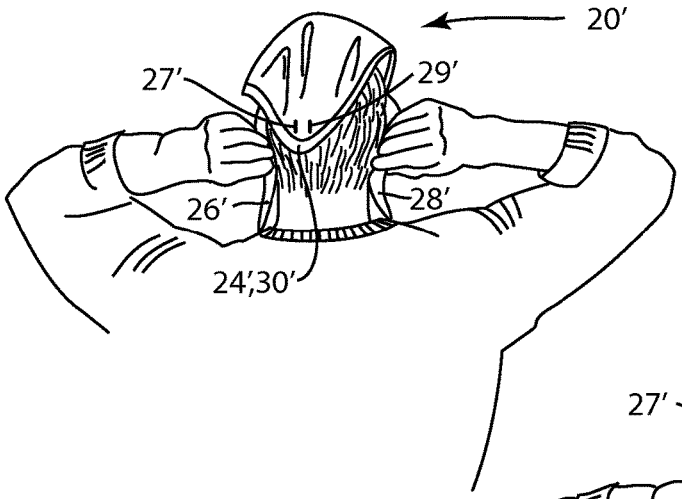
FIGS. 11A to 11D illustrate various steps of the user of FIG. 10 of tying the bandanna.

Turning to FIG. 9, after folding the material 21' into a triangle, a wearer grabs the folded corners 26' and 28' with their hands and positions the bandanna 20' such that the long edge 42' is against the wearer's forehead, as generally shown. In addition, the first and second corners 24' and 30' are draped over the top and back of the wearer's head as generally shown in FIG. 11A. By placing the long edge 42' of the bandanna 20' against the forehead of the wearer, indicia 38' and 40' that is located on the material 21' is oriented as generally shown in FIG. 10. In FIG. 10 the graphics 38' and 40' are shown being swept backwards along and close to the sides of the user's head and may be seen to emulate graphics displayed on a helmet, such as a football helmet.

Figure 11B:
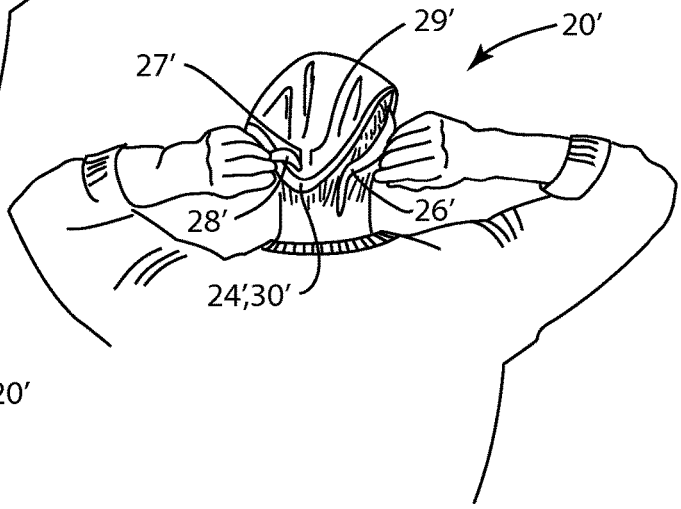
Figure 11C:
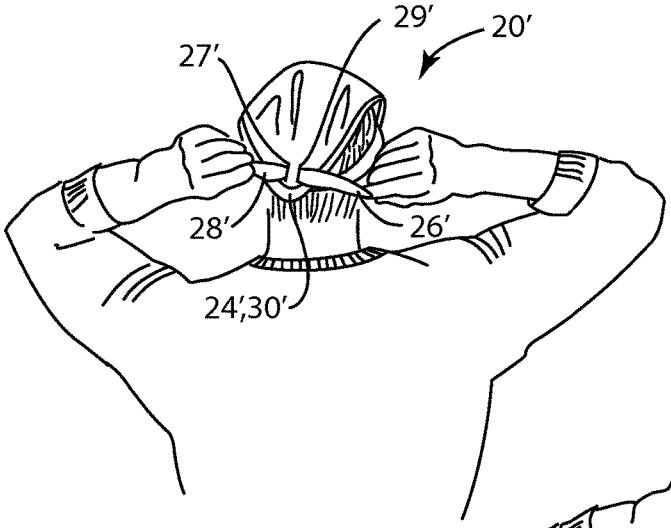
Figure 11D:
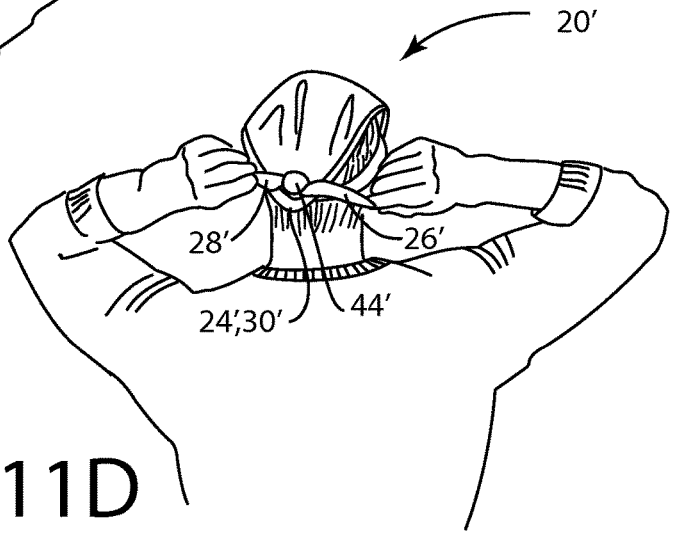

A method of tying the bandanna 20' will now be described with reference to FIGS. 11B to 11D. As shown in FIG. 11B, the third corner 28' is passed from a first direction through the aligned holes 29' and in FIG. 11C, the fourth corner 26' is passed from a second direction through the aligned holes 29'. Although FIGS. 11A and 11B show the third corner 28' and the fourth corner 26' routed through holes 27' and 29', respectively, from under the material 21' (i.e., between the head of the wearer and the material 21'), it will be appreciated that the routing may alternatively be over the material 21'. As shown in FIG. 11D, with the third and fourth corners 28' and 26' both being passed through the holes 27' and 29', the third and fourth corners are connected together, such as by tying them into a knot 44'. As a result of passage of the third and fourth corners 28' and 26' through the aligned holes 27' and 29', the first and second corners 24', 30' are interconnected with the third and fourth corners 28' and 26', so that the tied bandanna 20' can be worn as shown in FIG. 12.

Figure 12:
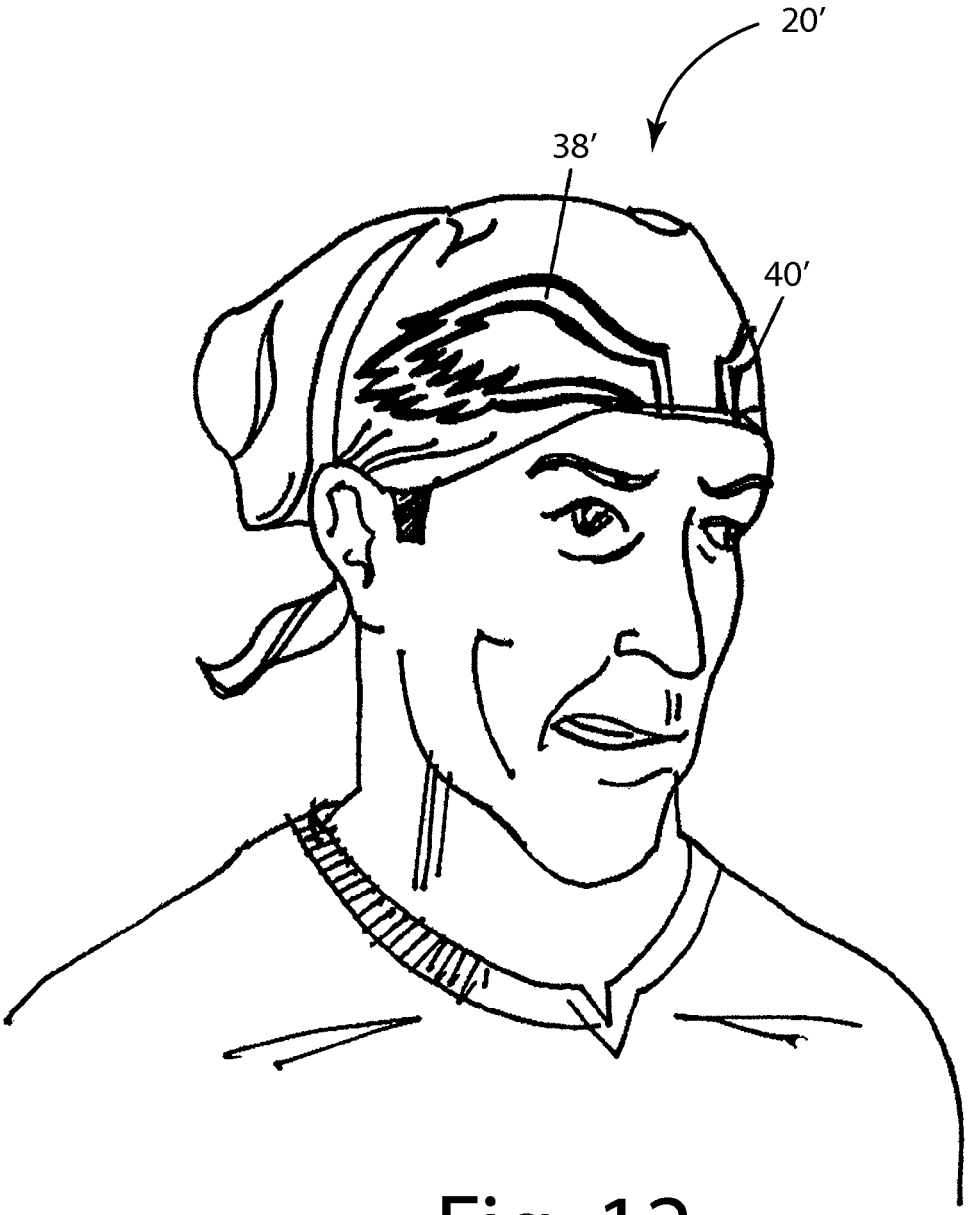
FIG. 12 is a perspective view illustrating the tied bandanna on the head of the wearer of FIGS. 9 to 11D with indicia on the bandanna displayed on the sides of the head of the wearer.

When the bandanna 20' is tied as shown in FIGS. 11A to 11D the third and fourth corners 26' and 28' are pulled taught so that the material 21' curves in conformity with the head of the wearer so that the bandanna 20' is form fitting, as shown in FIG. 12. Also, when the bandanna 20' is tied and the third and fourth corners 26' and 28' are pulled taught, the graphics 38' and 40' are displayed on opposing sides of a wearers head so as to emulate the graphics of a football helmet, as also shown in FIG. 12.

In comparison with conventional bandannas that are formed of a solid piece of material, the bandanna 20' described herein has an advantage of interconnecting the corners 24', 26', 28', and 30' of the material 21' such that there is less chance of the first and second corners 24' and 30' coming untucked from behind the wearers head. Thus, the wearer of the tied bandanna 20' shown in FIG. 12, for example, need not have to re-tie the bandanna in response to movement between the corners 24' and 30' and 26' and 28' of the material 21'. Also, owing to the interconnection of the corners 24', 26', 28', and 30' of the material 21', when the tied bandanna 20' is tied and worn as shown in FIG. 12, the graphics 38' and 40' remain close to the wearer's head and the material 21' remains form fitting so that the tied bandanna 20' maintains the appearance of a football helmet.

There have been described and illustrated herein several embodiments of a bandanna and a method of forming a bandanna on a head of a wearer. While particular embodiments of the invention have been described, it is not intended that the invention be limited thereto, as it is intended that the invention be as broad in scope as the art will allow and that the specification be read likewise. While the bandanna material described above has been described as being made of fabric or paper, the bandanna material may be made from virtually any material, such as a fabric (e.g., cotton, rayon, nylon) and even non-fabric materials, such as paper or plastic. Also, while the bandanna described herein has been described as being formed of a square material, it will be appreciated that other forms are possible. For example, in addition to the square piece of material, as generally shown in FIGS. 1 and 7, the bandanna may be formed from a generally triangular piece of material, thus eliminating the step of the user folding the bandanna into a triangle from a square. In addition to the square shape for the material, the material can be configured into other shapes such as rectangular, rounded, or arcuate shapes. In addition, while particular shapes of openings in the bandanna material have been disclosed, it will be understood that other shapes can be used. For example, and not by way of limitation, round, square, oval, and semicircular. Furthermore, while a knot has been described for connecting corners of a bandanna together, it will be understood that other methods or devices can be similarly used to join the corners together. It will therefore be appreciated by those skilled in the art that yet other modifications could be made to the provided invention without deviating from its spirit and scope as claimed.

What is claimed is:

1. A bandanna comprising:

a square piece of material defining a first, second, third, and fourth corner, wherein a first diametric axis bisects said first and second corners and a second diametric axis bisects said third and fourth corners, wherein said piece of material defines a pair of diametrically opposed openings through said piece of material, said pair of openings including a first opening through said piece of material and a second opening through said piece of material, wherein said first opening is at said first corner and said second opening is at said second corner diametrically opposite said first opening across said second diametric axis, and wherein said first and second openings intersect said first diametric axis, wherein in a first, folded configuration of said piece of material said piece of material is folded about said second diametric axis into a triangle to align said first opening with said second opening, and wherein in a second, connected configuration of said piece of material said third and fourth corners are interconnected with said first and second corners by said third and fourth corners being inserted through said aligned first and second openings, wherein the piece of material in the second configuration is configured to be worn on a head of a user with the first, second, third, and fourth corners disposed behind the head of the user.

2. The bandanna according to claim 1, wherein:

at least one of said first and second openings is an elongated slit.

3. The bandanna according to claim 2, wherein:

said elongated slit extends longitudinally parallel to said first diametric axis.

4. The bandanna according to claim 3, wherein:

said elongated slit extends along said first diametric axis.

5. The bandanna according to claim 1, wherein:

said piece of material is made from at least one of fabric and paper.

6. The bandanna according to claim 1, wherein:

said piece of material has at least one region for displaying indicia including at least one of sports related graphics, non-sports related graphics, and corporate logos.

7. The bandanna according to claim 6, wherein:

said at least one region is configured to be visible from opposing sides of said bandanna on a wearer's head.

8. A method of forming said bandanna of claim 1 on a head of a wearer, the method comprising:

providing said square piece of material;

folding said square piece of material into said first folded configuration by folding said square piece of material about said second diametric axis into said triangle to align said first pair of openings;

passing said third corner and said fourth corner through said first and second openings of said aligned first pair of openings; and connecting said third and fourth corners together into said second connected configuration.

9. The method according to claim 8, wherein said connecting includes tying a knot.

10. The method according to claim 8, wherein:

said square piece of material has at least one region for displaying indicia including at least one of sports related graphics, non-sports related graphics, and corporate logos, and said method further comprising: placing a long edge of the triangle against the forehead of the wearer so that the indicia are outwardly visible.

11. The method according to claim 10, wherein: said indicia are located on opposing sides of the first diametric axis of said bandanna on a wearer's head, and wherein said connecting said third and fourth corners together includes drawing the third and fourth corners taut to conform the square piece of material to the head of the wearer to emulate a football helmet and disposes the indicia to emulate a position of graphics on a football helmet.

12. A bandanna comprising:

a square piece of material defining a first, second, third, and fourth corner, wherein a first diametric axis bisects said first and second corners and a second diametric axis bisects said third and fourth corners, wherein said piece of material defines a first pair of diametrically opposed openings through said piece of material, and a second pair of diametrically opposed openings through said piece of material, said first pair of diametrically opposed openings including a first opening and a second opening diametrically opposite said first opening across said second diametric axis, and said second pair of diametrically opposed openings including a third opening and a fourth opening diametrically opposite said third opening across said second diametric axis, and wherein said first and second openings are elongated slits extending along a third axis that is parallel to said first diametric axis, and said third and fourth openings are elongated slits extending along a fourth axis that is parallel to said first diametric axis, wherein said third and fourth axes are spaced from the first diametric axis on opposite sides of said first diametric axis, wherein said piece of material is configured to be folded about said second diametric axis into a triangle to align said first opening with said second opening and to align said third opening with said fourth opening, and wherein said piece of material is configured to interconnect at least one of said third and fourth corners with said first and second corners through said first pair of openings, wherein:

said first opening and said third opening are defined at said first corner and spaced from one another across said first diametric axis, and said second opening and said fourth opening are defined at said second corner and spaced from one another across said first diametric axis, wherein in a first, folded configuration said piece of material is folded about said second diametric axis into a triangle to align said first opening with said second opening and align said third opening with said fourth opening, and wherein in a second, connected configuration of said piece of material said third corner is interconnected with said first and second corners by said third corner being inserted through said first pair of aligned openings, and said fourth corner is interconnected with said first and second corner by said fourth corner being inserted through said second pair of aligned openings, wherein the piece of material in the second configuration is configured to be worn on a head of a user with the first, second, third, and fourth corners disposed behind the head of the user.

* * * * *